US012006638B2

(12) United States Patent
Barry et al.

(10) Patent No.: US 12,006,638 B2
(45) Date of Patent: Jun. 11, 2024

(54) RAIL ANCHORING SPIKE

(71) Applicant: Lewis Bolt & Nut Company, Wayzata, MN (US)

(72) Inventors: David M. Barry, Greenwood, MN (US); Jeremy W. Soden, Rocky Ford, CO (US)

(73) Assignee: Lewis Bolt & Nut Company, Wayzata, MN (US)

( * ) Notice: Subject to any disclaimer, the term of this patent is extended or adjusted under 35 U.S.C. 154(b) by 851 days.

(21) Appl. No.: 17/025,411

(22) Filed: Sep. 18, 2020

(65) Prior Publication Data

US 2021/0079598 A1 Mar. 18, 2021

Related U.S. Application Data

(60) Provisional application No. 62/902,008, filed on Sep. 18, 2019.

(51) Int. Cl.

| | |
|---|---|
| ***E01B 9/06*** | (2006.01) |
| ***E01B 9/10*** | (2006.01) |
| *E01B 13/02* | (2006.01) |

(52) U.S. Cl.
CPC ..... *E01B 9/06* (2013.01); *E01B 9/10* (2013.01); *E01B 13/02* (2013.01)

(58) Field of Classification Search
CPC ... E01B 9/10; E01B 9/06; E01B 13/02; E01B 2201/04; F16B 15/06; F16B 39/30; F16B 39/32
USPC ..... 238/372, 375; 411/399, 454
See application file for complete search history.

(56) References Cited

U.S. PATENT DOCUMENTS

| | | | | |
|---|---|---|---|---|
| 994,330 A * | 6/1911 | Morris | F16B 15/06 411/453 |
| 2,256,401 A * | 9/1941 | Maze | F16B 15/06 24/114.05 |
| 2003/0111543 A1* | 6/2003 | Oram | E01B 9/10 238/29 |

* cited by examiner

*Primary Examiner* — Zachary L Kuhfuss
(74) *Attorney, Agent, or Firm* — Fish & Richardson P.C.

(57) ABSTRACT

An improved rail anchoring spike that includes barbs is used for fastening metal to ties. The spike includes a head having one or more flanges and a stand-off extending axially from the flange(s). The spike includes a shank extending axially from the stand-off to form a tapered tip. The shank is adapted to engage dense material of the tie by a combination of threads and barbs on the shank. The threads are generally parallel and extend over a threaded portion of the shank. The shank includes a plurality of barbs positioned in a lower half of the threaded portion. Each barb is positioned between a pair of threads. Each barb is configured to minimize damage to fibers of the tie during installation of the spike as the fibers relax behind, and engage with, a barbed end. This prevents movement of the spike over time despite deterioration of the tie.

72 Claims, 11 Drawing Sheets

RAIL ANCHORING SPIKE

CROSS-REFERENCE TO RELATED APPLICATIONS

This application claims the benefit of U.S. Provisional Application Ser. No. 62/902,008, filed Sep. 18, 2019. The disclosure of the prior application is considered part of (and is incorporated by reference in) the disclosure of this application.

TECHNICAL FIELD

This present disclosure relates to fasteners for attaching metal to wood, and more particularly to an improved railroad spike for attaching a metal rail to a wooden tie.

BACKGROUND

It is common in constructing tracks for trains to provide a rail or rails supported on cross ties formed of wood. The rails are commonly made of a metal such as steel, and are generally provided with mounting flanges. The mounting flanges are adapted to rest on metallic bearing plates, commonly referred to as tie plates or fishplates. The fishplates in turn rest on the wooden ties. It is common to employ spikes (e.g., cut spikes) for securing rails to ties. In the usual case, a spike is inserted in an opening or cavity in the fishplate and the spike shank is driven into the tie. The head of the spike is generally adapted to engage with the flange of the rail, thereby securing the rail to the tie. Alternatively, the fishplate may be equipped with a metal clip or boss that engages to the flange of the rail, and the head of the spike is adapted to engage with the fishplate to secure the rail to the tie.

Over time, ties tend to deteriorate, generally beginning at the top of the tie and progressing downward toward lower portions of the tie. The deterioration can cause the upper portion of the tie to be weaker than the lower portion of the tie. Therefore, after being in service for a period of time, an ordinary spike can often work loose from the tie. This is further caused by the working action that occurs as the rail deflects under the load of passing trains and due to expansion and contraction of the wood fibers of the tie due to temperature, humidity, and other environmental changes. Such loosening of the spike can necessitate replacement of the spike or other parts of the track assembly. Attempts to secure or anchor a spike by providing the shank with burrs, barbs, serrations, or similar rough features adapted to engage with the wooden ties generally have proven unsatisfactory. Such spikes can be difficult to drive into a tie using manual or automated impact spike-driving methods. The rough feature may also chew or tear the wood fibers of the tie during installation, thereby causing damage to the tie.

In addition, after such spikes have been in service for an appreciable length of time, the spikes will have a tendency to work in the hole established in the tie by the spike shank. Working of the spike acts to enlarge the hole surrounding the shank and to damage the surrounding wood fibers, causing the spike to loosen over time. The enlarged hole may also permit water and chemicals to enter the hole surrounding the spike shank, thereby further weakening the spike or the surrounding wood fibers. Removal of the spike usually causes additional damage to the tie. Therefore, spike removal often requires replacement of the entire tie in order to ensure that the replacement spike will anchor the rail to the tie with sufficient holding power.

Spikes have been adapted with threaded shanks that can be screwed into the wooden tie. However, such spikes are difficult to install using manual or automated impact driving methods. Furthermore, such spikes generally require a pre-drilled hole in the tie to facilitate installation using rotary spike driving methods. Threaded spikes are also known to work loose under the load of passing trains. In an attempt to reduce working of spikes under load, attempts have been made to equip spikes with tabs or uniquely shaped shanks adapted to engage with the cavity of a fishplate, thereby locking the spike into engagement with the fishplate, reducing the tendency of the spike to work loose and damage the tie. Such spikes, however, are extremely difficult to install using automated impact spike-driving methods. In addition, such spikes can generally be used only in conjunction with a fishplate, and are extremely difficult to remove once locked into engagement with the fishplate.

The art continually searches for improved spikes suitable for use in securing a metal rail to a wooden tie. In particular, the art continues to search for spikes that exhibit a reduced tendency to work loose under the load of passing trains, for spikes that are readily removed and re-installed without requiring replacement of the tie, and for spikes that are capable of installation using automated spike-driving methods.

SUMMARY

This present disclosure relates generally to an improved fastener for attaching metal to wood. A spike design that includes barbs, as described in the present disclosure, can overcome issues associated with tie deterioration and the tendency of spikes to work loose from the tie. The spike design limits damage during installation of the spike, while engaging the tie upon relaxation of fibers in the tie behind each barb.

More specifically, in one aspect, the present disclosure features an improved railroad spike for attaching a metal rail to a wooden tie. The improved spike is well-suited for use with automated spike-driving methods. The improved spike is adapted to engage with the wooden tie to prevent or reduce loosening of the spike, such as due to working of the spike under the load of a passing train or due to expansion or contraction of the wood fibers in response to changing environmental conditions.

The improved spike can be used, for example, as a rail anchoring spike to fasten metal to a tie (such as a wooden tie). The spike includes a head having one or more flanges. The spike also includes a stand-off extending axially from a bottom flange of the one or more flanges. The spike further includes a shank that extends axially from the stand-off to form a tapered tip. The shank is adapted to engage the tie by a combination of threads and barbs on the shank. For example, the shank includes a plurality of helical, generally parallel threads extending over a threaded portion of the shank. The threads run from the stand-off to the tapered tip. The stand-off has a length adapted to ensure that the threads are fully engaged in the tie when the spike is used to fasten metal to the tie. The threads are adapted to engage the tie at a depth in the tie that ensures engagement with dense material of the tie.

The shank includes a plurality of barbs positioned in a lower half of the threaded portion. Each of the barbs is positioned between a pair of threads. Each barb is configured to minimize damage to fibers of the tie during installation of the spike as fibers of the tie relax behind, and engage with, a barbed end of each barb. This prevents movement of the spike over time despite deterioration of the tie. Each of the barbs is positioned along the threaded portion such that the barbs contact a lower portion of the tie when the spike is installed in a rail assembly.

In some embodiments, each of the barbs includes a starting point, a pointed barb, and a barb body. The starting point is oriented away from the one or more flanges and originates in a valley between the pair of threads. The pointed barb is on the barbed end of the barb. The barb body extends from the starting point to the barbed end. The barb body grows in height and width relative to the valley. The barb end forms a substantially flat surface oriented generally perpendicular to an axis of the barb and to ridges formed by the pair of threads.

In some embodiments, the barbed end of the spike has a height that is within a height range ranging between slightly less than and slightly more than heights of the ridges. In some embodiments, the plurality of barbs are positioned at distances within a distance range ranging between slightly less than and slightly more than a barb distance axially from the stand-off. In some embodiments, the barbs are positioned approximately 2 inches (or within 1.5-2.5 inches) from the tapered tip.

In some embodiments, the spike is made of metal, such as hardened steel. In some embodiments, the tie comprises at least wood. In some embodiments, the shank is cylindrical.

In some embodiments, the one or more flanges include a first flange and a second flange separated by a spacer portion. The first flange is adjacent to the stand-off. In some embodiments, the first flange and the second flange are circular. In some embodiments, the spacer portion is circular. In some embodiments, the spacer portion has a length of about three-eighths of one inch. In some embodiments, the head includes a hemispherical surface opposite to the first flange. The surface is adapted for driving the spike. In some embodiments, the head includes a projecting polygonal tool grip opposite to the one or more flanges. The tool grip is adapted to engage with a wrench.

In some embodiments, the length of the stand-off is minimum of 4 centimeters (cm). In some embodiments, the length of the stand-off is long enough to partially embed into the tie. In some embodiments, the threads are adapted to cause rotation of the spike into tie when a force is applied to the head of the spike in a direction towards the tapered tip. In some embodiments, the barb is shaped to minimize damage to fibers of the tie upon entry and to ensure relaxation of the fibers behind the barb.

In some embodiments, the head of the spike comprises a generally polygonal projecting tool grip extending axially from the flange on the side opposite to the threaded shank. Some embodiments include first and second flanges. In these embodiments, the head of the spike extends axially from the first flange on the side opposite to the spacer portion. The tool grip is adapted for engagement with a wrench to enable rotary driving of the spike into the tie or removal of the spike using a rotary motion imparted to the tool grip.

In some embodiments, the spike head is adapted for use with impact spike-driving methods. A hemispherical head of the spike is preferably hemispherical or dome shaped and is adapted to for use with manual or automated impact spike-driving methods. Preferably, the hemispherical head is adapted to deform slightly under impact driving, thereby preventing damage to the tool grip.

In some embodiments, the threads are adapted to facilitate driving of the spike into the wooden tie using impact or rotary spike-driving methods, and to permit easy removal of the spike using rotary spike removal methods. In some embodiments, the threaded shank is adapted to permit driving of the spike into the tie using an impact driving method, and to permit easy removal of the spike using a wrench or other rotary spike removal method. The threads are adapted to cause rotation of the spike into the tie during installation using automated or manual impact spike-driving methods. The threads are preferably adapted to screw the spike threads into the wooden tie when a force is applied to the hemispherical head of the spike in a direction generally towards the spike tip.

In some embodiments, the improved spike is used with a metal tie plate or fishplate to secure the rail to the tie. In this embodiment, the length of the stand-off must be adapted to ensure that the threads are at least partially engaged with the wooden tie when the spike is driven into the tie. The tie plate or fishplate preferably comprises a metal boss or an elastic fastener that is adapted to engage with the flange of the rail, thereby securing the rail to the tie when the spike is driven into the tie.

In another aspect, the present disclosure features an improved railroad track assembly. The assembly comprises a metal rail, a tie (e.g. wooden), a metal tie plate adapted to engage the rail, and an improved spike of the present disclosure. The improved spike is driven into the tie. The spike is adapted to fasten the tie plate and the rail to the tie. The improved spike includes features as previously described.

In still another aspect, the present disclosure features a method of using an improved railroad spike. The method includes using a railroad spike for fastening metal to a tie. A railroad spike is provided that includes features as previously described. A wooden tie, a metal rail, and a fishplate adapted to engage with the rail and the tie are provided. The spike is driven into the tie until the threads and the barbs are embedded in the tie, and the fishplate is engaged with the rail.

In some embodiments, the fishplate further includes a metal boss that is adapted to hold the rail onto the tie. In some embodiments, the fishplate includes a top face, a lower face, and a cavity having a length extending between the top face and the lower face. In some embodiments, the stand-off is at least as long as the cavity. In some embodiments, the length of the stand-off is a 1.5-2.5 inches (e.g., 2 inches).

In some variations of this embodiment, an automated spike-driving method is used to drive the spike into the tie, thereby securing a metal rail to the wooden tie. Preferably, an automated impact spike-driving method is employed. In alternative embodiments, a manual spike driving apparatus is used to drive the improved spike into the tie.

The details of one or more embodiments of the present disclosure are set forth in the accompanying drawings and the description below. Other features, objects, and advantages of the present disclosure will be apparent from the description and drawings, and from the claims.

DESCRIPTION OF DRAWINGS

Like reference symbols in the various drawings indicate like elements.

DETAILED DESCRIPTION

Figure 1A:
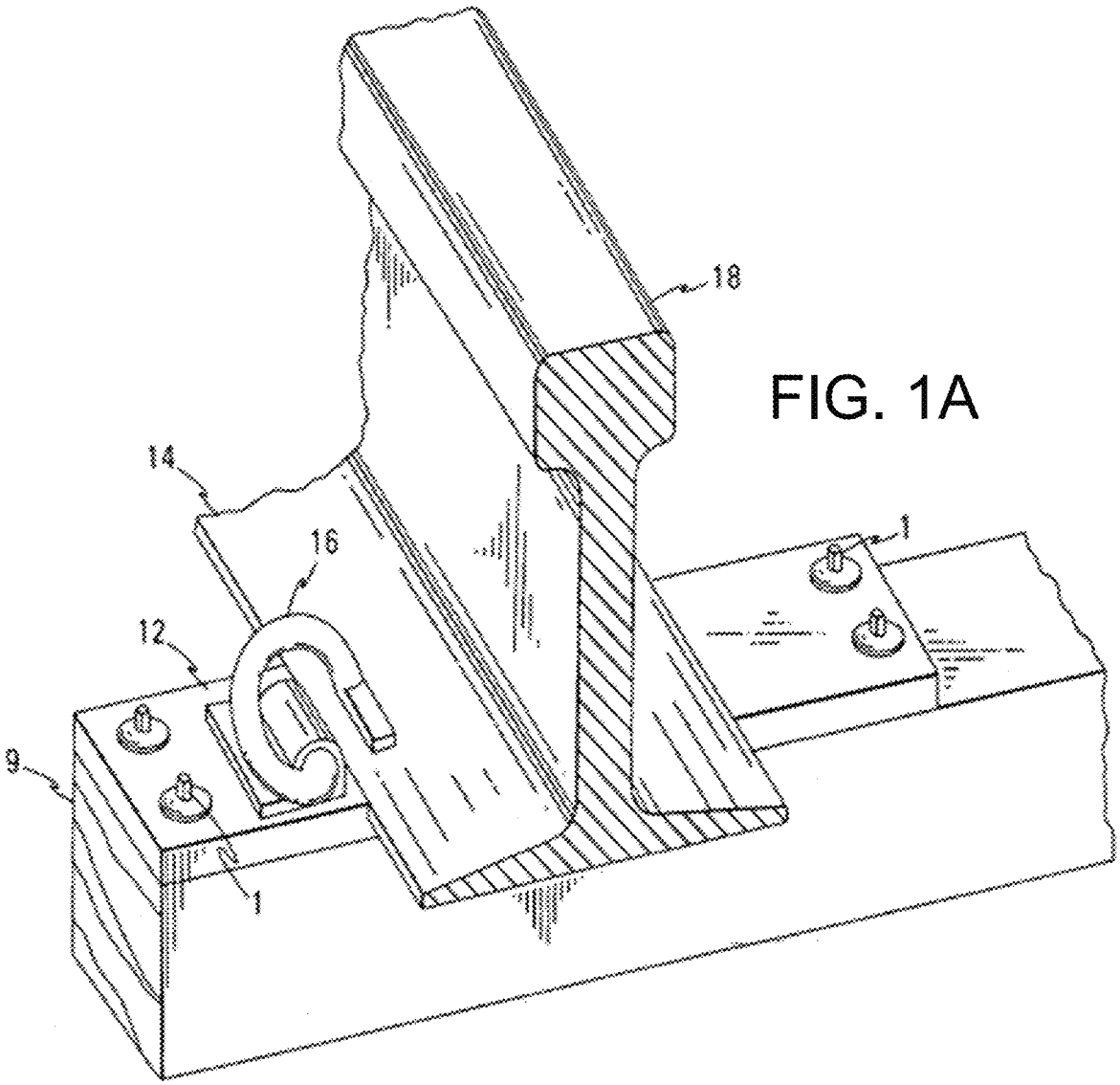
FIGS. 1A and 1B are perspective view of examples of a typical metal-to-wood fastening application embodying the present disclosure.
Figure 1B:
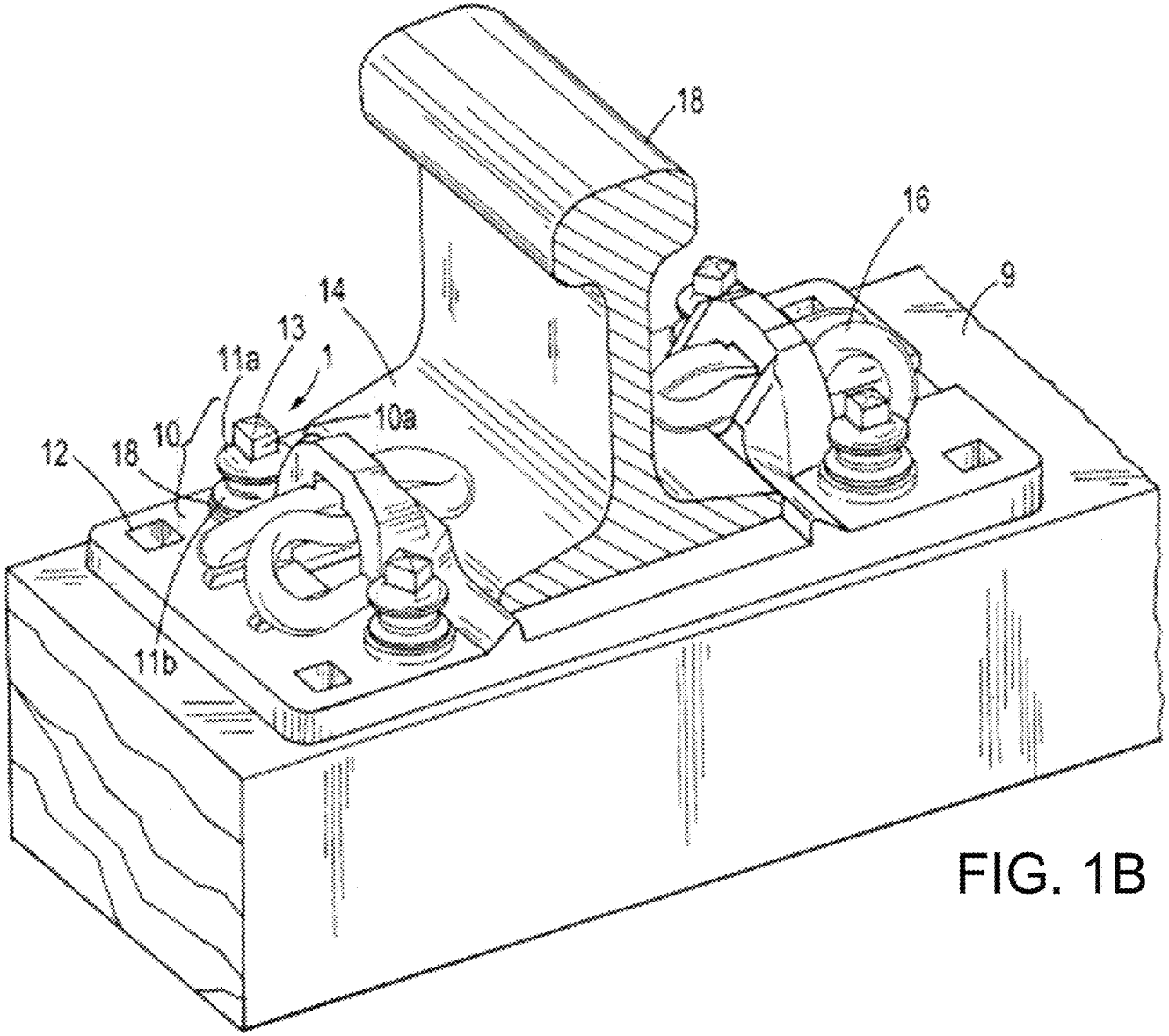

FIGS. 1A and 1B are perspective view of examples of typical metal-to-wood fastening applications embodying the present disclosure. FIGS. 1A and 1B illustrate the fastening of a metal rail 18 to a wooden tie 9 using a spike 1 (an improved spike) of the present disclosure. In the illustrated embodiment, a metal tie plate or fishplate 12 comprising a boss or elastic fastener 16 engages with the flange 14 of rail 18. A plurality of spikes 1 are inserted into cavities in the fishplate 12, to secure the fishplate 12 and the rail 18 to the tie 9.

Figure 2:
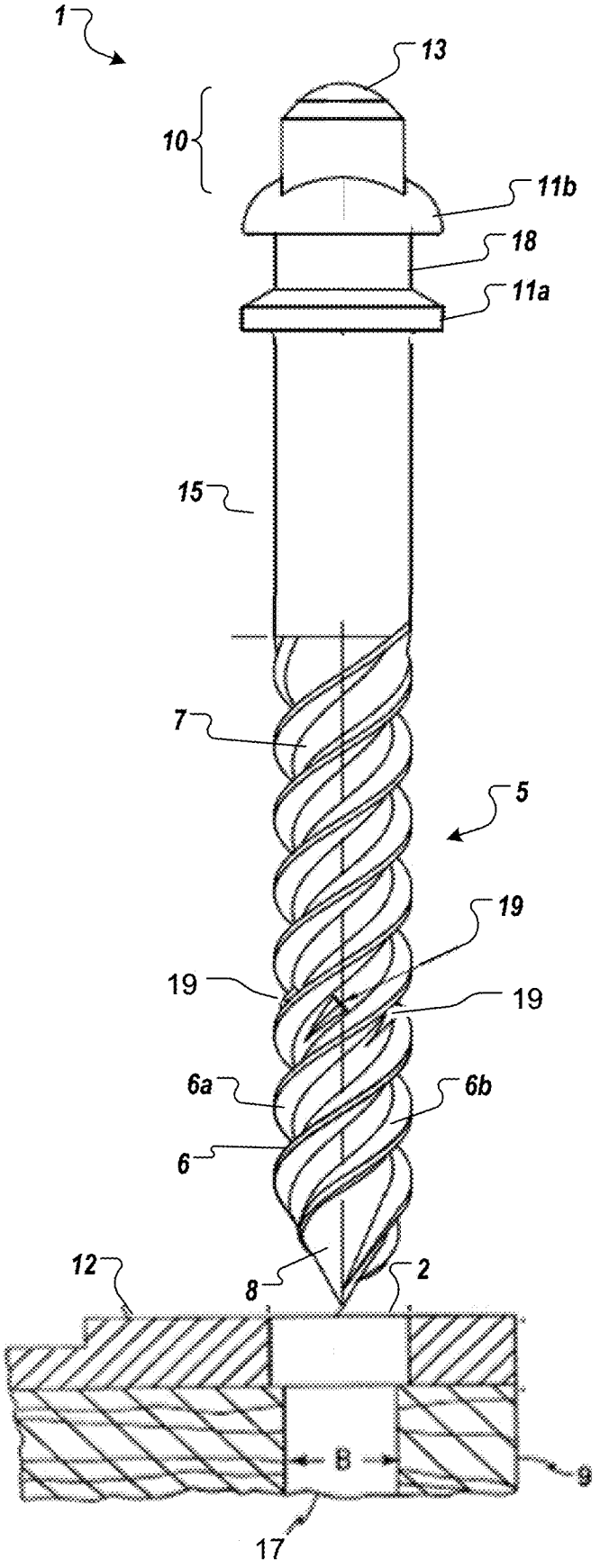
FIG. 2 is a side elevation view of an example of a spike embodying the present disclosure.

FIG. 2 is a side elevation view of an example of a spike embodying the present disclosure. The spike 1 includes barbs 19 positioned between threads 6 of a threaded portion of the spike 1. The barbs 19 are positioned in a lower half of the threaded portion. Each barb is configured to minimize damage to fibers of a wooden tie 9 during installation of the spike 1 as fibers of the tie 9 relax behind, and engage with, a barbed end of each barb. This prevents movement of the spike over time despite deterioration of the tie. Each of the barbs is positioned along the threaded portion such that the barbs contact a lower portion of the tie when the spike is installed in a rail assembly.

The spike has a head 10 having one or more flanges, for example, first and second annular flanges 11*a* and (optionally) 11*b*. The first and second annular flanges 11*a* and 11*b* are axially spaced by spacer portion 18. In some embodiments, the diameter of first annular flange 11*a* is preferably greater than the diameter of second annular flange 11*b*. The spike has a stand-off 15 extending axially from the first flange 11*a*, a shank 5 extending axially from the stand-off 15 to form a tapered tip 8, and a plurality of pitched, helical, generally parallel threads 6 extending over at least a portion of the shank, running from the stand-off 15 to the tip 8. The threads have an upper thread surface 6*b*, and a lower thread surface 6*a*.

As shown in FIG. 2, the helical threads preferably have an upper thread surface 6*b* which defines an obtuse pitch angle relative to the nearest adjacent land 7 which is substantially closer to ninety degrees than the pitch angle defined between the lower thread surface 6*a* and the nearest adjacent land 7. Because this thread design allows the spike 1 to freely screw into the tie 9 when a force is applied to the head (e.g., the spike is driven), such a thread design is particularly well suited for use with automated spike driving equipment. Most preferred is automated impact spike driving equipment that drives the spike by applying a force to the spike head substantially in the direction of the tip of the shank. Suitable automated spike driving equipment includes the Nordco Model 99C spike driver (Nordco, Inc., Milwaukee, Wisconsin), Fairmont Tamper Model W96 (Fairmont Tamper, a Division of Harsco Track Technologies, Company, West Columbia, South Carolina) or the like.

Figure 3A:
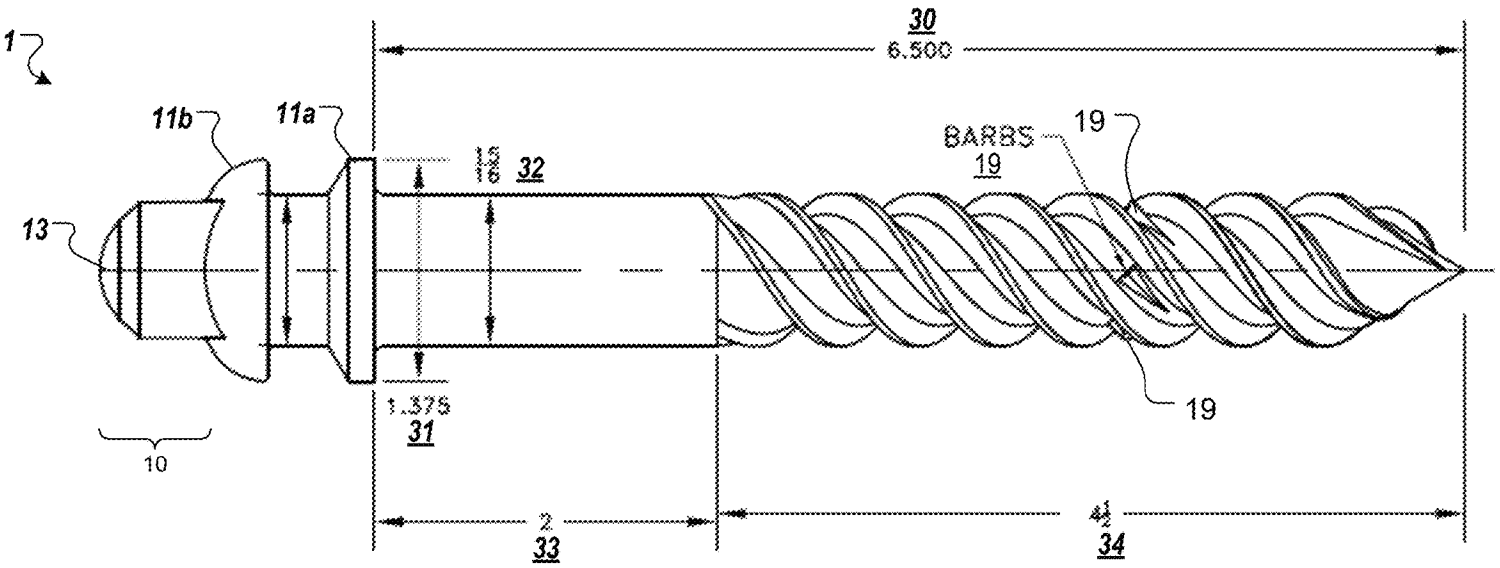
FIG. 3A is a side elevation view of an example of a spike with two flanges embodying the present disclosure.

FIG. 3A is a side elevation view of an example of a spike with two flanges embodying the present disclosure. The view shows examples of a length 30 (e.g., 6.5 inches, or within a range of 6-7 inches) of the shank, a diameter 31 (e.g., 1.375 inches) of the first flange 11*a*, a diameter 32 (e.g., 15/16 inch) of the stand-off, a length 33 (e.g., 2 inches, or between 1.5-2.5 inches) of the stand-off, and a length 34 (e.g., 4.5 inches) of the threaded portion of the spike. Other dimensions and lengths are possible, such as to conform to various installations where different thicknesses of ties and plates may exist. Other axial locations and configurations are possible as well.

Figure 3B:
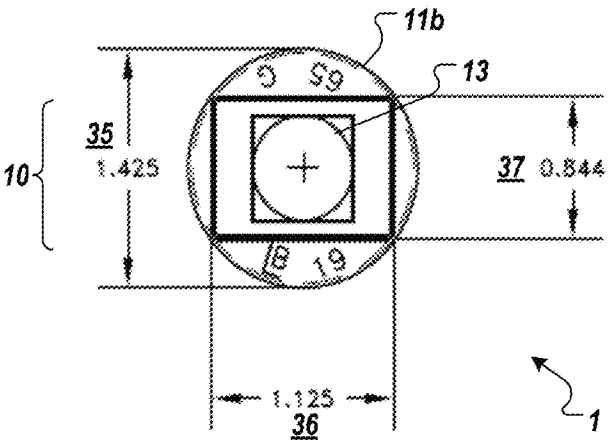
FIG. 3B is a top plan view of an example of the spike with two flanges embodying the present disclosure.

FIG. 3B is a top plan view of an example of the spike with two flanges embodying the present disclosure. The view shows examples of a diameter 35 (e.g., 1.425 inches) of the second annular flanges 11*a*, a length 36 (e.g., 1.125 inches) of a head, and a width 37 (e.g., 0.844 inches) of a head. Other dimensions and lengths are possible, such as to conform to various installations where thickness of ties and plates may exist.

Figures 4A, 4B, 4C:
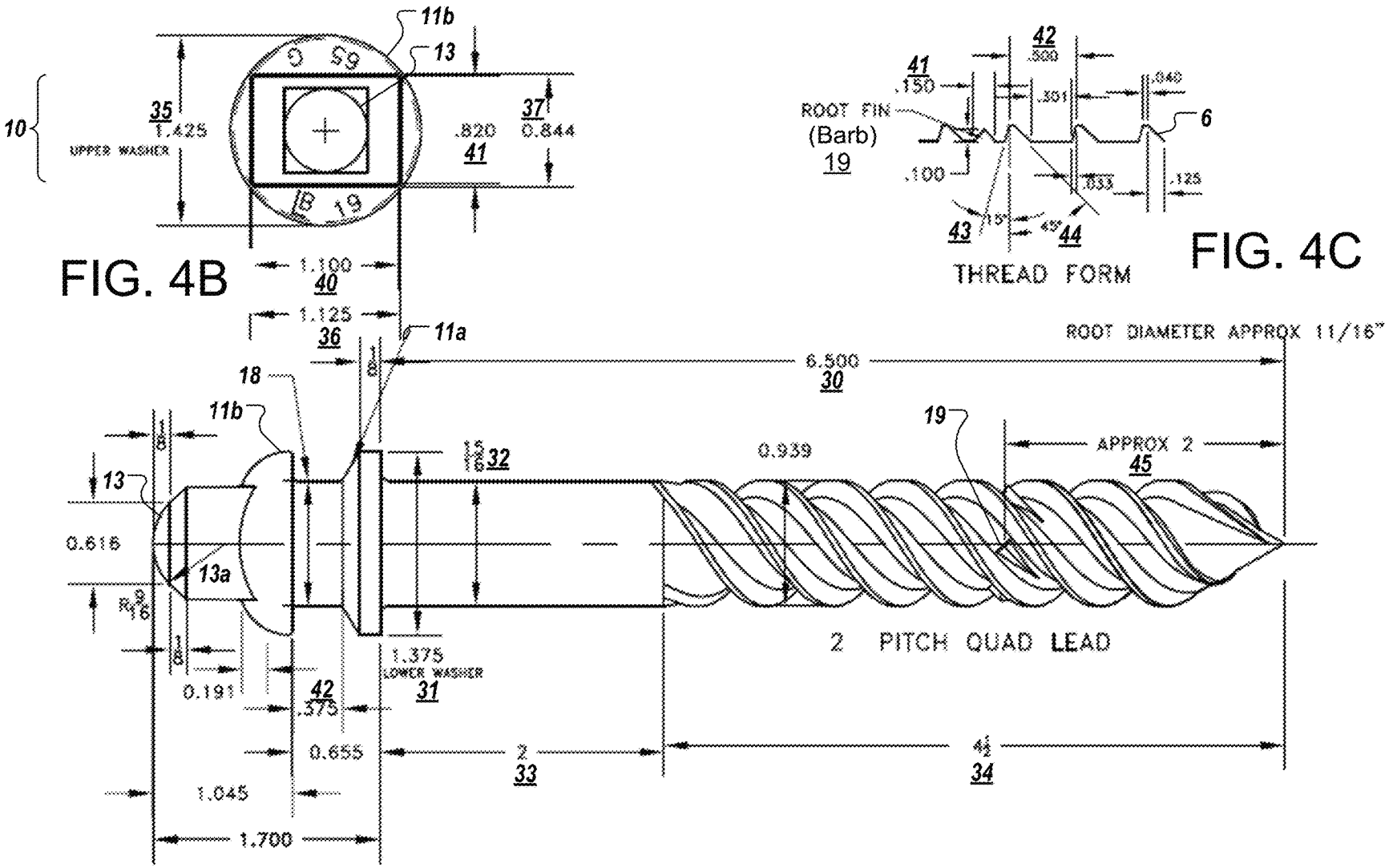
FIG. 4A is a side elevation view showing example dimensions of an example of the spike with two flanges embodying the present disclosure.
FIG. 4B is a top plan view showing example dimensions of an example of the spike with two flanges embodying the present disclosure.
FIG. 4C is a side elevation view showing example dimensions of an example of a thread form embodying the present disclosure.

FIG. 4A is a side elevation view showing example dimensions of an example of the spike with two flanges embodying the present disclosure. A length 42 of the spacer portion 18 exists between the first flange 11*a* and the second flange 11*b*. A distance 45 (e.g., approximately 2.0 inches) exists between the barbs 19 and the tip of the spike.

FIG. 4B is a top plan view showing example dimensions of an example of the spike with two flanges embodying the present disclosure. As shown in FIG. 4B, a length 40 (e.g., 1.100 inches) and a width 41 (e.g., 0.820 inches) at the top of the head, when combined with the length 36 and the width 37, provide a projecting polygonal tool grip with a slightly tapered head that facilitates engagement with tools.

FIG. 4C is a side elevation view showing example dimensions of an example of a thread form embodying the present disclosure. The view shows a width 41 (e.g., 0.150 inch) of the barb 19, a distance 42 (e.g., 0.5 inch) between threads, an angle 43 (e.g., 15 degrees) of an upper thread surface 6*b* relative to the axis of the spike, and an angle 44 (e.g., 45 degrees) of a lower thread surface 6*a* relative to the axis of the spike.

Figure 5A:
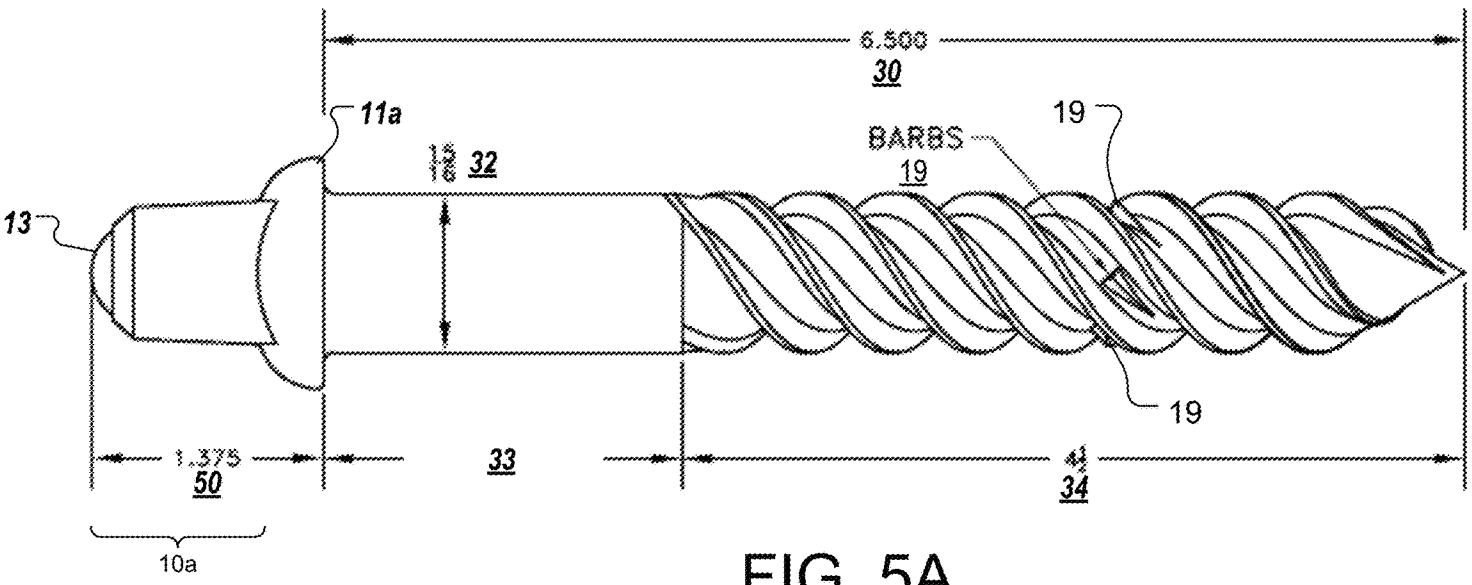
FIG. 5A is a side elevation view of an example of a spike with one flange embodying the present disclosure.
Figure 5B:
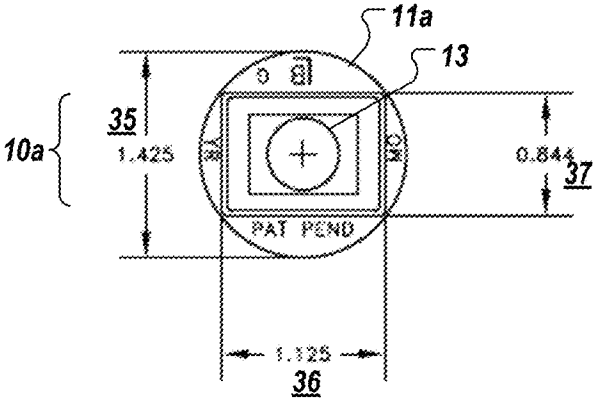
FIG. 5B is a top plan view of an example of the spike with one flange embodying the present disclosure.

FIG. 5A is a side elevation view of an example of a spike with one flange embodying the present disclosure. A length 50 (e.g., 1.375 inches) can include the first flange 11*a*, the head 10*a*, and the hemispherical head 13 of radius 13*a*(e.g., 9/16 inch). FIG. 5B is a top plan view of an example of the spike with one flange embodying the present disclosure.

Figures 6A, 6B, 6C:
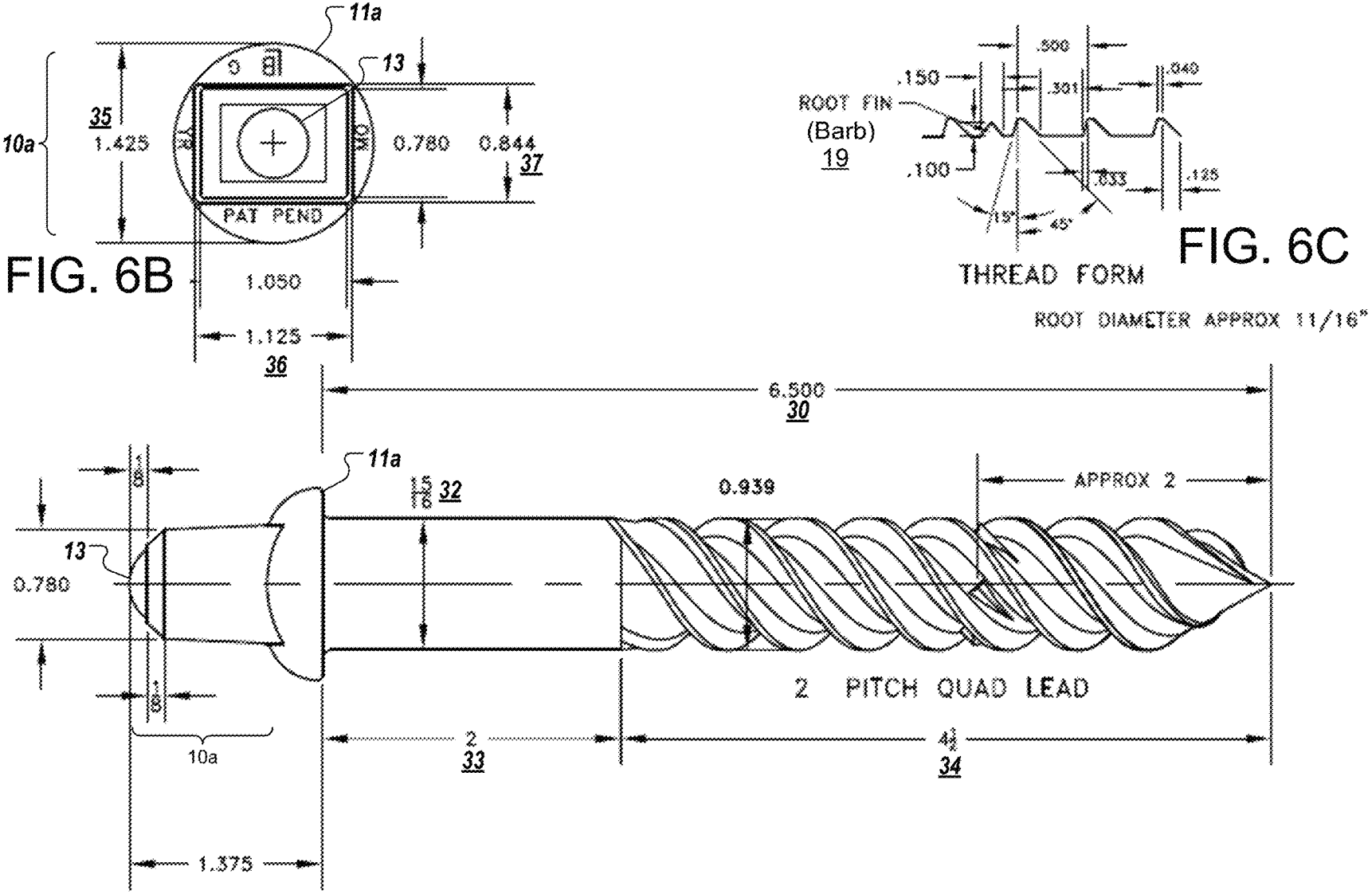
FIG. 6A is a side elevation view showing example dimensions of an example of the spike with one flange embodying the present disclosure.
FIG. 6B is a top plan view showing example dimensions of an example of the spike with one flange embodying the present disclosure.
FIG. 6C is a side elevation view showing example dimensions of an example of a thread form embodying the present disclosure.

FIG. 6A is a side elevation view showing example dimensions of an example of the spike with one flange embodying the present disclosure. FIG. 6B is a top plan view showing example dimensions of an example of the spike with one flange embodying the present disclosure. FIG. 6C is a side elevation view showing example dimensions of an example of a thread form embodying the present disclosure. The spike with one flange can have similar dimensions as the two-flange spike of FIGS. 4A-4C.

Figure 7:
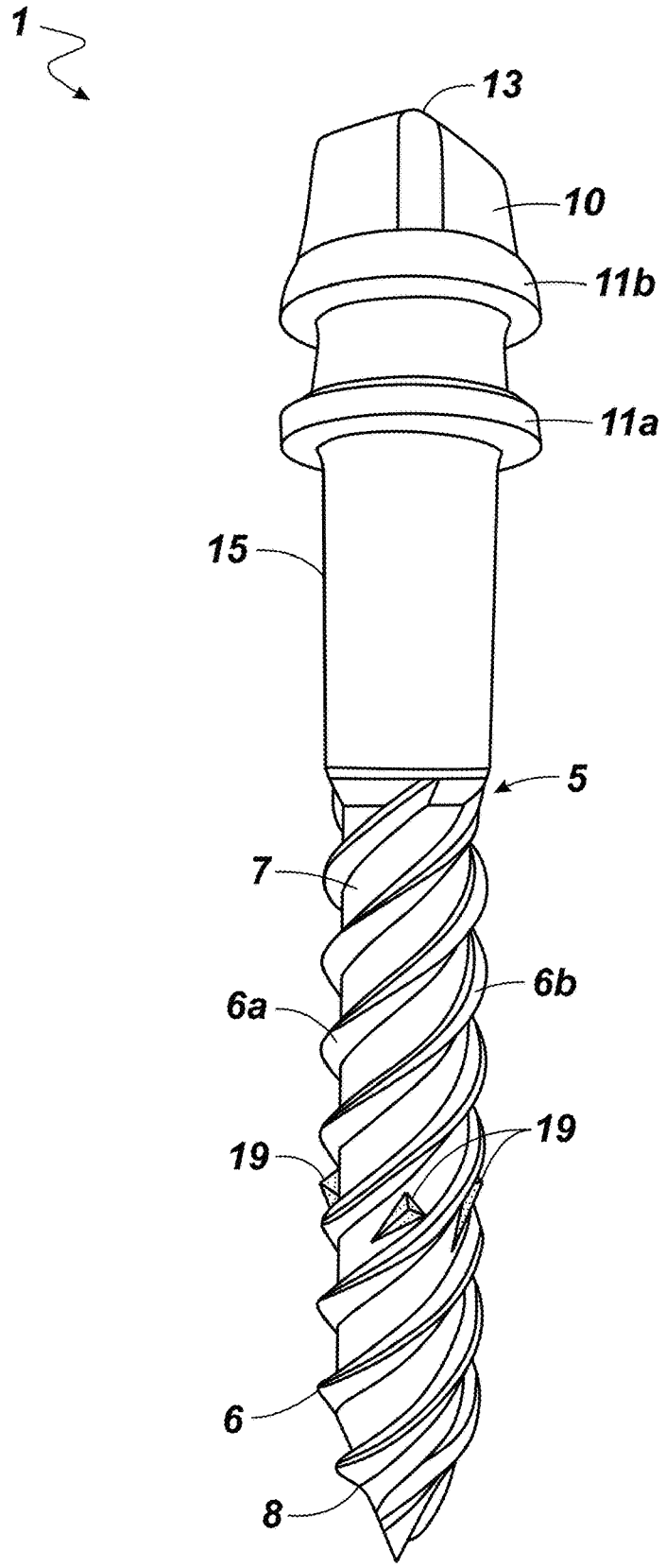
FIGS. 7-9 are images showing features of an example spike embodying the present disclosure.
Figure 8:
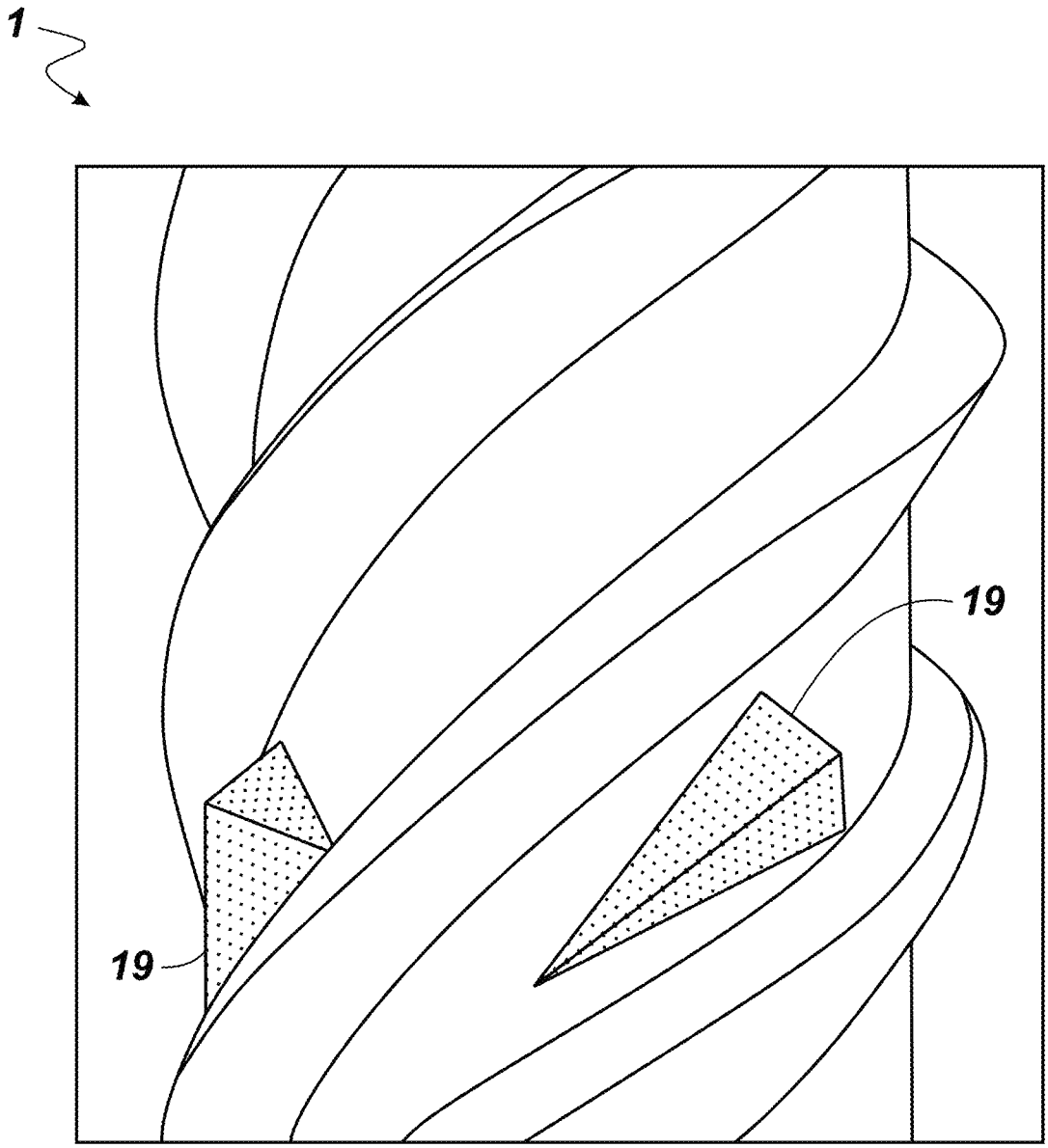
Figure 9:
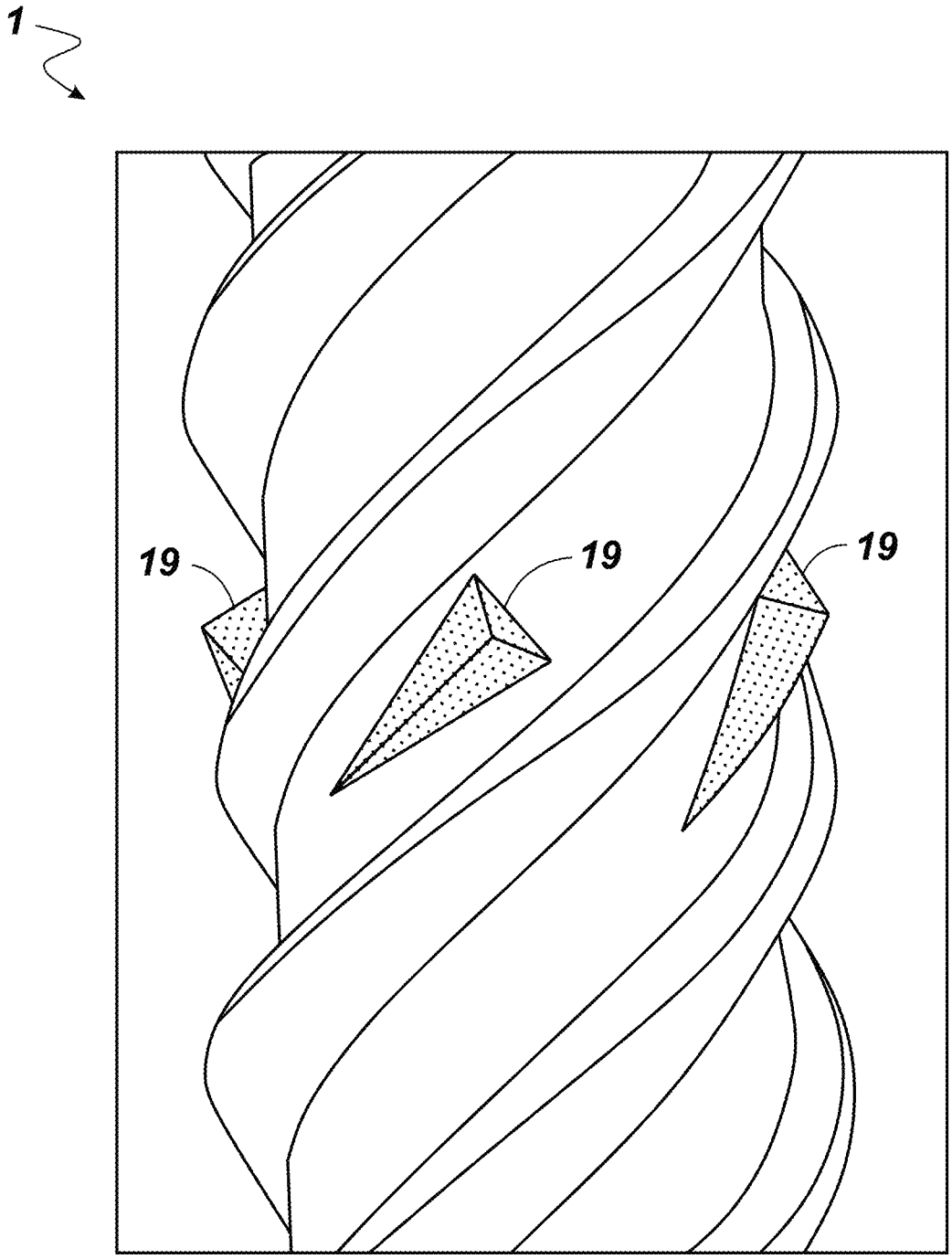

FIGS. 7-9 are images showing features of an example spike embodying the present disclosure.

As depicted in FIGS. 2, 3A-3B, and 4A-4B, the head 10 comprises a projecting polygonal tool grip extending axially from the second flange 11*b* on the side opposite the spacer portion 18. As depicted in FIGS. 5A-5B, and 6A-6B, the head 10*a* comprises a projecting polygonal tool grip extending axially from the flange on the side opposite to the threaded shank. Although the shape of the tool grip is not critical, it is generally adapted for engagement by a wrench to enable rotary driving of the spike into the tie or removal of the spike using a rotary motion imparted to the tool grip. It will be understood by those skilled in the art that a variety of equivalent structures may be substituted for the projecting polygonal tool grip without departing from the present disclosure. Thus, for example, the head of the spike may comprise a generally polygonal recessed tool socket positioned on the flange on the side of the first flange opposite to the spacer portion as shown in FIGS. 2, 3A-3B, and 4A-4B (or in the case of the embodiment shown in FIGS. 5A-5B, and 6A-6B, on the side opposite to the threaded shank). The recessed socket is preferably adapted for engagement with a socket wrench or socket driver to enable rotary driving of the spike into the tie or removal of the spike using a rotary motion imparted to the socket.

A hemispherical head 13 can be provided to permit driving of the spike into the tie using impact spike driving methods that apply a force to the head 13 of the spike in the general direction of the spike tip. The hemispherical head 13 is preferably deformable by virtue of the material used to make the head 13, and is adapted to deform slightly under impact driving, thereby preventing damage to the tool grip that could prevent removal of the spike using a wrench. In addition, the thread design allows the spike 1 to be readily driven using hand operated impact spike driving equipment such as hammers, sledges, mauls, or power-driven/hand operated spike drivers such as the Ingersol Rand Spike Driver Model MX60, (Ingersol Rand, Inc.), Ingersol Rand Spike Driver Model MX 90 (Ingersol Rand, Inc.), or the like.

Preferably, the pitched helical threads 6 are adapted to permit driving of the spike 1 into the tie 9 using a generally clockwise rotary motion applied to the tool grip, and to permit removal of the spike 1 from the tie 9 using a generally counter-clockwise rotary motion applied to the tool grip. Both clockwise and counterclockwise directions refer to the rotational direction of the tool grip when viewing the spike from the side of the flange opposite to the shank. Alternatively, the threads 6 are adapted to permit driving of the spike 1 into the tie 9 using a generally clockwise rotary motion applied to the tool grip, and to permit removal of the spike 1 from the tie 9 using a generally counter-clockwise rotary motion applied to the tool grip.

The spike 1 is generally used with a metal tie plate or fishplate 12 to secure the rail 18 to the tie 9. If a fishplate is used, the fishplate preferably comprises a metal boss or elastic fastener 16 adapted to engage with the flange 14 of the rail, and a cavity into which the shank of the spike may be inserted to permit driving of the spike into the tie. As shown in FIGS. 1A and 1B, the rail flange 14 preferably rests on the tie plate or fishplate 12, and the tie plate or fishplate 12 preferably rests on the wooden tie 9.

FIG. 2 further illustrates use of the spike 1 in combination with a metal fishplate 12 having a cavity 2, and the wooden tie 9. Preferably, the tie 9 includes a cavity 17 to accommodate the shank 5 of the inventive spike. Preferably, the stand-off 15, the threaded shank 5, the fishplate cavity 2 and the tie cavity 17 are all substantially cylindrical. The fishplate cavity 2 has a diameter A greater than or equal to the diameter E of the stand-off 15, and preferably has a diameter A greater than or equal to the diameter F of the threaded shank 5. In some embodiments, a substantially cylindrical cavity 17 having a diameter B is formed in the tie 9 before inserting the tip 8 of the spike 1. In these embodiments, the diameter B of cavity 17 is less than the diameter F of the threaded shank.

It will be understood by those skilled in the art that the diameter and overall length of the spike are not critical, and may be varied according to the dimensions of the tie and tie plate or fishplate. Even though the overall length of the spike is not critical and may be any suitable length, this length is generally in the range of 15-25 cm. However, the length D of the stand-off 15 must be adapted to ensure that the threads are engaged with the wooden tie 9 when the spike 1 is driven into the tie 9. This also ensures that the barbs 19 are engaged with the wooden tie 9 with a force sufficient to prevent or reduce the tendency for the spike to loosen under the load of passing railroad locomotives and rolling stock (not shown). Preferably, the length D of the stand-off 15 is at least as long as the length C of the cavity in the fishplate 12, thereby ensuring that the threads are fully-engaged with the wooden tie. Most preferably, the length of the stand-off is between about 2 cm to 5 cm. The threads, and particularly the use of the barbs 19, can prevent loosening of the spike 1 over time regardless of deterioration of the tie nearest the surface.

Notwithstanding the improvements embodied in the present disclosure, it will be understood by those skilled in the art that it may be necessary to replace components of a railroad track assembly due to damage or wear. Such replacement will generally require the removal of one or more spikes. It is understood that some damage to the wooden tie may occur due to repeated removal or installation of improved spikes of the present disclosure. An aspect of the present disclosure therefore involves removal of an improved spike having a first stand-off length, and replacement with an improved spike having a second, longer stand-off length, in order to ensure that the threads of the replacement spike engage wood fibers that are substantially undamaged by the removed spike.

Figure 10:
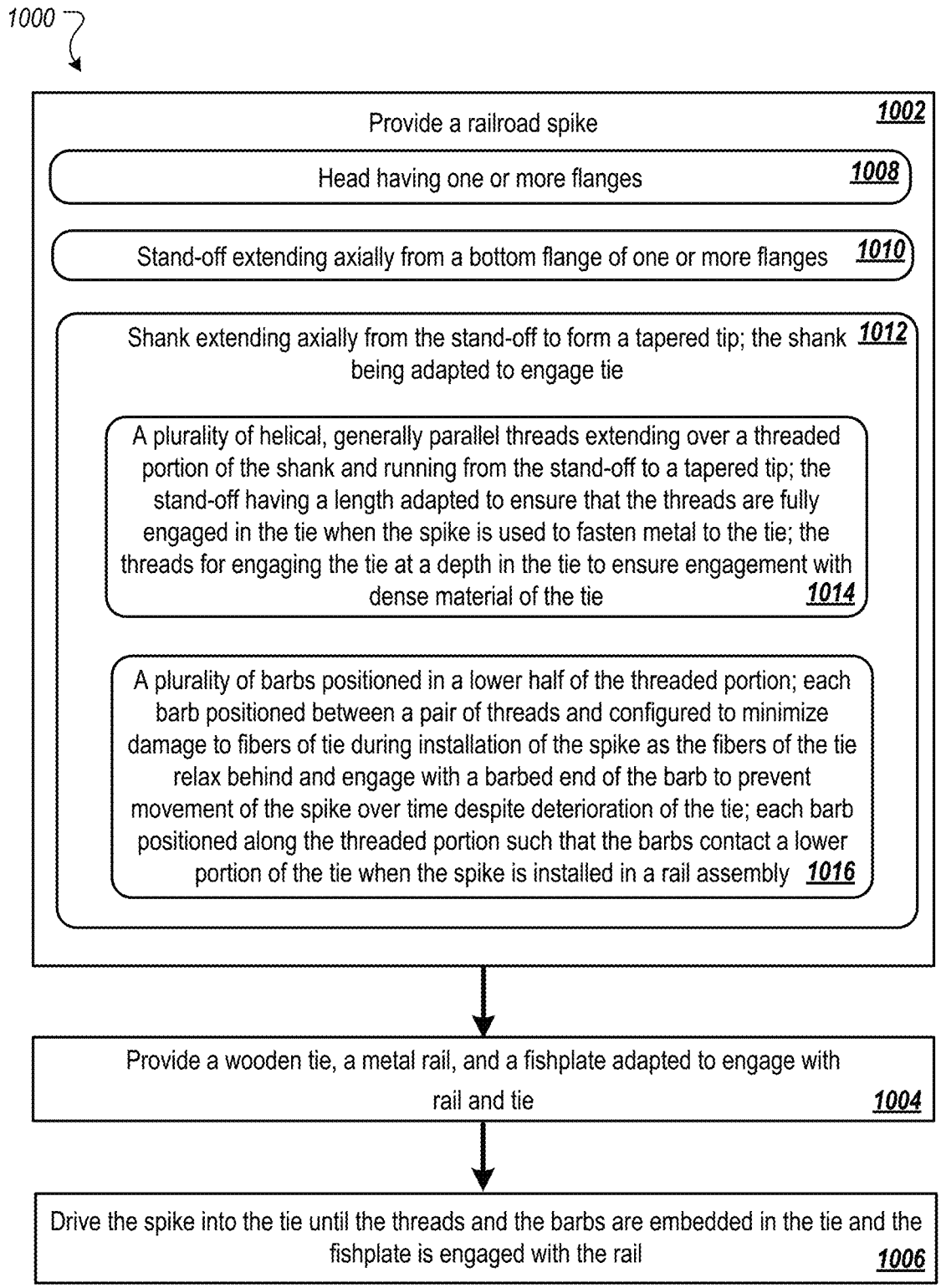
FIG. 10 is a flow chart of an example of a method for installing a spike embodying the present disclosure.

The head design of the spike depicted in FIGS. 2, 3A-3B, and 4A-4B aids in the removal of the spike. The flanges 11*a* and 11*b*, and the spacer portion 18 allow for a claw or other automated or manual tool to engage or grip the spike and remove it. The flanges 11*a* and 11*b* preferably are circular, but may be of any shape suitable for the intended application. As shown in FIGS. 2, 3A-3B, and 4A-4B, the diameter of second flange 11*b* is preferably greater than the diameter of first flange 11*a*, spacer portion 18 may be of any suitable length or shape for an intended application. In one embodiment, the spacer portion is circular in a cross-section perpendicular to the longitudinal axis of the spike, and is about ⅜ of one inch in length. When installed (as illustrated in FIG. 10), the head 10, having two flanges as shown in FIGS. 2, 3A-3B, and 4A-4B, will be exposed for use with a claw or other automated or manual tool to remove the spike 1. The surface of second flange 11*b* on the side opposite the spacer portion 18 will sit on the fishplate 12 if a fish plate is used (see FIG. 10), and the first and second flanges 11*a* and 11*b*, separated by spacer portion 18, will be above the fishplate.

Preferably, the spike comprises a metal. Although the spike may be made of any number of metals or metal alloys, ferrous metals such iron or steel are preferred. Ferrous metals are preferred for use with an automated spike driving apparatus, since magnetic forces may then be used to hold the spike in operational engagement with the driving device.

Another aspect of this present disclosure provides an improved railroad track assembly. The assembly comprises a metal rail, a wooden tie, a metal tie plate adapted to engage the rail, and an improved spike of the present disclosure. The improved spike is described in the previous detailed description of the present disclosure and in FIGS. 1-9.

In an embodiment of this improved track assembly, the improved spike is driven into a wooden tie to secure a metal rail and a metal tie plate to the tie. The tie plate is adapted to engage the rail at the rail flange. The improved spike comprises a head having an annular flange (or in the case of the embodiment depicted in FIGS. 2, 3A-3B, and 4A-4B, a head having first and second axially spaced flanges), a stand-off extending axially from the one or more flanges, and a shank extending axially from the stand-off to form a tapered tip.

In some variations of this embodiment, the shank further comprises a plurality of helical, generally parallel threads extending over at least a portion of the shank, running from the stand-off to the tip. In one variation of this embodiment, the threads are adapted to permit driving of the spike into the tie using an impact driving method, and to permit easy removal of the spike using a wrench or other rotary spike removal method. The threads are generally parallel, helical threads extending from the stand-off in the direction of the tip. The threads are adapted to cause rotation of the spike into the tie during installation using automated or manual impact spike-driving methods. In other words, the helical threads are preferably adapted to screw the spike threads into the wooden tie when a force is applied to the hemispherical head 13 of the spike in a direction generally towards the spike tip.

In another variation of this embodiment, the spike head is adapted for use with impact spike-driving methods. The hemispherical head 13 of the spike is preferably hemispherical or dome shaped and is adapted to for use with manual or automated impact spike-driving methods. Preferably, the hemispherical head 13 is adapted to deform slightly under impact driving, thereby preventing damage to the tool grip.

The present disclosure also provides a method of using an improved railroad spike to secure a metal rail and a metal tie plate to a wooden tie. The improved spike is described in the preceding detailed description of the present disclosure and in FIGS. 1-9. The improved method comprises the step of driving the improved spike into the tie to secure the rail and the tie plate to the tie. The tie plate is adapted to engage the rail at the rail flange. The tie plate preferably comprises a metal boss or elastic fastener (e.g., an e-clip) that engages the rail flange when the improved spike of the present disclosure is driven into the tie, thereby securing the tie plate and the rail to the tie.

In some embodiments, the tie plate comprises a cavity into which the tip of the spike shank is inserted before the spike is driven into the tie. The improved spike of the present disclosure is preferably driven into the tie until the spike flange engages with the tie plate and the threads and barbs of the spike engage the wood of the tie. In the usual case, a hole or cavity (e.g., a pilot hole) is bored into the wooden tie before the spike tip is inserted into the tie plate cavity and the spike is driven into the hole or cavity of the tie. Preferably, the hole or cavity bored in the wooden tie has a diameter smaller than the diameter of the shank of the improved spike.

FIG. 10 is a flow chart of an example of a method 1000 for installing a spike embodying the present disclosure.

At 1002, a railroad spike is provided. The railroad spike includes a head (1008) having one or more flanges, a stand-off (1010) extending axially from a bottom flange of the one or more flanges, and a shank (1012) extending axially from the stand-off to form a tapered tip. The shank is adapted to engage the tie. The shank includes a plurality of helical, generally parallel threads (1014) extending over a threaded portion of the shank and running from the stand-off to the tapered tip. The stand-off has a length adapted to ensure that the threads are fully engaged in the tie when the spike is used to fasten metal to the tie. The threads are for engaging the tie at a depth in the tie to ensure engagement with dense material of the tie. The shank also includes a plurality of barbs (1016) positioned in a lower half of the threaded portion. Each of the barbs is positioned between a pair of threads and configured to minimize damage to fibers of the tie during installation of the spike as fibers of the tie relax behind and engage with a barbed end of the spike to prevent movement of the spike over time despite deterioration of the tie. Each of the barbs is positioned along the threaded portion such that the barbs contact a lower portion of the tie when the spike is installed in a rail assembly.

At 1004, a wooden tie, a metal rail, and a fishplate adapted to engage with the rail and the tie are provided.

At 1006, the spike is driven into the tie until the threads and the barbs are embedded in the tie, and the fishplate is engaged with the rail.

In some embodiments, a driving device is used to drive the spike into the tie, thereby securing the metal rail to the wooden tie. Generally, the driving device may be either an impact driver, such as a hammer, sledge, or maul; or a rotary driver, such as an open-end wrench, box end wrench, socket wrench, or socket driver. Preferably, an automated impact spike-driving method is employed.

Other embodiments of the present disclosure are within the scope of the following claims.

What is claimed is:

1. A rail anchoring spike for fastening metal to a tie, comprising:

(a) a head having one or more flanges;

(b) a stand-off extending axially from a bottom flange of said one or more flanges; and (c) a shank extending axially from said stand-off to form a tapered tip; said shank being adapted to engage said tie; said shank comprising:

i) a plurality of helical, generally parallel threads extending over a threaded portion of said shank and running from said stand-off to said tapered tip; said stand-off having a length adapted to ensure that said threads are fully engaged in said tie when said spike is used to fasten metal to said tie; said threads for engaging said tie at a depth in said tie to ensure engagement with dense material of said tie; and ii) a plurality of barbs positioned in a lower half of said threaded portion; each of said barbs: (1) having a starting point and a barb body extending along a length from said starting point to a barbed end that has a substantially triangular cross-sectional shape, and (2) being positioned substantially centrally in a valley defined between a pair of threads and configured to minimize damage to fibers of said tie during installation of said spike as fibers of said tie relax behind and engage with said barbed end of said barb to prevent movement of said spike over time despite deterioration of said tie;

wherein:

said length of said barb body is greater than a maximum width of said substantially triangular cross-sectional shape of said barbed end;

said length of said barb body extends generally parallel to said threads; and each of said barbs is positioned along said threaded portion such that said barbs contact a lower portion of said tie when said spike is installed in a rail assembly.

2. The spike according to claim 1, wherein each of said barbs comprises:

said starting point oriented away from said one or more flanges and originating in said valley between said pair of threads; and a pointed end on said barbed end;

said barb body growing in height and width relative to said valley; and said barb end forming a substantially flat surface oriented generally perpendicular to an axis of said barb and to ridges formed by said pair of threads.

3. The spike according to claim 2, wherein a height of said barbed end is within a height range ranging between slightly less than and slightly more than heights of said ridges.

4. The spike according to claim 1, wherein said plurality of barbs are positioned at distances within a distance range ranging between slightly less than and slightly more than a barb distance axially from said stand-off.

5. The spike according to claim 1, wherein said barbs are positioned between 1.5 and 2.5 inches from said tapered tip.

6. The spike according to claim 1, wherein said spike is comprised of metal.

7. The spike according to claim 1, wherein said shank is cylindrical.

8. The spike according to claim 1, wherein said one or more flanges comprise a first flange and a second flange separated by a spacer portion, said first flange being adjacent to said stand-off.

9. The spike according to claim 8, wherein said first flange and said second flange are circular.

10. The spike according to claim 8, wherein said spacer portion is circular.

11. The spike according to claim 8, wherein said spacer portion has a length of about three-eighths of one inch.

12. The spike according to claim 8, wherein said head comprises a hemispherical surface opposite to said first flange, said surface adapted for driving said spike.

13. The spike according to claim 1, wherein said head comprises a projecting polygonal tool grip opposite to said one or more flanges, said tool grip adapted to engage with a wrench.

14. The spike according to claim 1, wherein said length of said stand-off is between 1.5 and 2.5 inches.

15. The spike according to claim 1, wherein length of stand-off to be long enough to partially embed into said tie.

16. The spike according to claim 1, wherein said threads are adapted to cause rotation of said spike into tie when a force is applied to said head of said spike in a direction towards said tapered tip.

17. The spike according to claim 1, wherein said tie comprises at least wood.

18. The spike according to claim 1, wherein said barb is shaped to minimize damage to fibers of said tie upon entry and to ensure relaxation of said fibers behind said barb.

19. The spike according to claim 1, wherein said shank has a length between 6 and 7 inches.

20. A railroad track assembly comprising a metal rail, a tie, a metal tie plate adapted to engage said rail, and a spike driven into said tie, said spike adapted to fasten said tie plate and said rail to said tie, said spike comprising:

(a) a head having one or more flanges;

(b) a stand-off extending axially from a bottom flange of said one or more flanges; and (c) a shank extending axially from said stand-off to form a tapered tip; said shank being adapted to engage said tie; said shank comprising:

i) a plurality of helical, generally parallel threads extending over a threaded portion of said shank and running from said stand-off to said tapered tip; said stand-off having a length adapted to ensure that said threads are fully engaged in said tie when said spike is used to fasten metal to said tie; said threads for engaging said tie at a depth in said tie to ensure engagement with dense material of said tie; and ii) a plurality of barbs positioned in a lower half of said threaded portion; each of said barbs: (1) having a starting point and a barb body extending along a length from said starting point to a barbed end that has a substantially triangular cross-sectional shape, and (2) being positioned substantially centrally in a valley defined between a pair of threads and configured to minimize damage to fibers of said tie during installation of said spike as fibers of said tie relax behind and engage with said barbed end of said barb to prevent movement of said spike over time despite deterioration of said tie;

wherein:

said length of said barb body is greater than a maximum width of said substantially triangular cross-sectional shape of said barbed end;

said length of said barb body extends generally parallel to said threads; and each of said barbs is positioned along said threaded portion such that said barbs contact a lower portion of said tie when said spike is installed in a rail assembly.

21. The railroad track assembly according to claim 20, wherein each of said barbs comprises:

(a) said starting point oriented away from said one or more flanges and originating in said valley between said pair of threads; and (b) a pointed end on said barbed end;

said barb body growing in height and width relative to said valley; and said barb end forming a substantially flat surface oriented generally perpendicular to an axis of said barb and to ridges formed by said pair of threads.

22. The railroad track assembly according to claim 21, wherein a height of said barbed end is within a height range ranging between slightly less than and slightly more than heights of said ridges.

23. The railroad track assembly according to claim 20, wherein said plurality of barbs are positioned at distances within a distance range ranging between slightly less than and slightly more than a barb distance axially from said stand-off.

24. The railroad track assembly according to claim 20, wherein said barbs are positioned between 1.5 and 2.5 inches from said tapered tip.

25. The railroad track assembly according to claim 20, wherein said spike is comprised of metal.

26. The railroad track assembly according to claim 20, wherein said shank is cylindrical.

27. The railroad track assembly according to claim 20, wherein said one or more flanges comprise a first flange and a second flange separated by a spacer portion, said first flange being adjacent to said stand-off.

28. The railroad track assembly according to claim 27, wherein said first flange and said second flange are circular.

29. The railroad track assembly according to claim 27, wherein said spacer portion is circular.

30. The railroad track assembly according to claim 27, wherein said spacer portion has a length of about three-eighths of one inch.

31. The railroad track assembly according to claim 27, wherein said head comprises a hemispherical surface opposite to said first flange, said surface adapted for driving said spike.

32. The railroad track assembly according to claim 20, wherein said head comprises a projecting polygonal tool grip opposite to said one or more flanges, said tool grip adapted to engage with a wrench.

33. The railroad track assembly according to claim 20, wherein said length of said stand-off is between 1.5 and 2.5 inches.

34. The railroad track assembly according to claim 20, wherein length of stand-off to be long enough to partially embed into said tie.

35. The railroad track assembly according to claim 20, wherein said threads are adapted to cause rotation of said spike into tie when a force is applied to said head of said spike in a direction towards said tapered tip.

36. The railroad track assembly according to claim 20, wherein said tie comprises at least wood.

37. The railroad track assembly according to claim 20, wherein said barb is shaped to minimize damage to fibers of said tie upon entry and to ensure relaxation of said fibers behind said barb.

38. The railroad track assembly according to claim 20, wherein said shank has a length between 6 and 7 inches.

39. A method of using a railroad spike for fastening metal to a tie, comprising:

(a) providing a railroad spike comprising:

i) a head having one or more flanges;

ii) a stand-off extending axially from a bottom flange of said one or more flanges; and iii) a shank extending axially from said stand-off to form a tapered tip; said shank being adapted to engage said tie; said shank comprising:

A. a plurality of helical, generally parallel threads extending over a threaded portion of said shank and running from said stand-off to said tapered tip; said stand-off having a length adapted to ensure that said threads are fully engaged in said tie when said spike is used to fasten metal to said tie; said threads for engaging said tie at a depth in said tie to ensure engagement with dense material of said tie; and B. a plurality of barbs positioned in a lower half of said threaded portion; each of said barbs: (1) having a starting point and a barb body extending along a length from said starting point to a barbed end that has a substantially triangular cross-sectional shape, and (2) being positioned substantially centrally in a valley defined between a pair of threads and configured to minimize damage to fibers of said tie during installation of said spike as fibers of said tie relax behind and engage with said barbed end of said barb to prevent movement of said spike over time despite deterioration of said tie;

wherein:

said length of said barb body is greater than a maximum width of said substantially triangular cross-sectional shape of said barbed end;

said length of said barb body extends generally parallel to said threads; and each of said barbs is positioned along said threaded portion such that said barbs contact a lower portion of said tie when said spike is installed in a rail assembly;

(b) providing a tie, a metal rail, and a fishplate adapted to engage with said rail and said tie; and (c) driving said spike into said tie until said threads and said barbs are embedded in said tie, and said fishplate is engaged with said rail.

40. The method according to claim 39, wherein each of said barbs comprises:

(a) said starting point oriented away from said one or more flanges and originating in said valley between said pair of threads; and (b) a pointed end on said barbed end;

said barb body growing in height and width relative to said valley; and said barb end forming a substantially flat surface oriented generally perpendicular to an axis of said barb and to ridges formed by said pair of threads.

41. The method according to claim 40, wherein a height of said barbed end is within a height range ranging between slightly less than and slightly more than heights of said ridges.

42. The method according to claim 39, wherein said plurality of barbs are positioned at distances within a distance range ranging between slightly less than and slightly more than a barb distance axially from said stand-off.

43. The method according to claim 39, wherein said barbs are positioned between 1.5 and 2.5 inches from said tapered tip.

44. The method according to claim 39, wherein said spike is comprised of metal.

45. The method according to claim 39, wherein said shank is cylindrical.

46. The method according to claim 39, wherein said one or more flanges comprise a first flange and a second flange separated by a spacer portion, said first flange being adjacent to said stand-off.

47. The method according to claim 46, wherein said first flange and said second flange are circular.

48. The method according to claim 46, wherein said spacer portion is circular.

49. The method according to claim 48, wherein said spacer portion has a length of about three-eighths of one inch.

50. The method according to claim 46, wherein said head comprises a hemispherical surface opposite to said first flange, said surface adapted for driving said spike.

51. The method according to claim 39, wherein said head comprises a projecting polygonal tool grip opposite to said one or more flanges, said tool grip adapted to engage with a wrench.

52. The method according to claim 39, wherein said length of said stand-off is between 1.5 and 2.5 inches.

53. The method according to claim 39, wherein length of stand-off to be long enough to partially embed into said tie.

54. The method according to claim 39, wherein said threads are adapted to cause rotation of said spike into tie when a force is applied to said head of said spike in a direction towards said tapered tip.

55. The method according to claim 39, wherein said tie comprises at least wood.

56. The method according to claim 39, wherein said barb is shaped to minimize damage to fibers of said tie upon entry and to ensure relaxation of said fibers behind said barb.

57. The method according to claim 39, wherein said shank has a length between 6 and 7 inches.

58. The method according to claim 39, wherein said fishplate further comprises a metal boss, and said boss is adapted to hold said rail onto said tie.

59. The method according to claim 39, wherein said fishplate comprises a top face, a lower face, and a cavity having a length extending between said top face and said lower face.

60. The method according to claim 59, wherein said stand-off is at least as long as said cavity.

61. The method according to claim 59, wherein said cavity is circular, and said stand-off is cylindrical.

62. The method according to claim 61, wherein a diameter of said cavity is greater than a diameter of said stand-off.

63. The method according to claim 39, further comprising the step of boring a hole in said tie before driving said spike into said hole in said tie.

64. The method according to claim 39, wherein driving comprises engaging a driving device with said head.

65. The method according to claim 64, wherein said driving device is an automated spike driver.

66. The method according to claim 65, wherein said driving device is an automated impact spike driver.

67. The method according to claim 64, wherein said driving device is power driven and hand-operated.

68. The method according to claim 64, wherein said driving device is selected from the group consisting of impact drivers and rotary drivers.

69. The method of claim 68, wherein said driving device is an impact driver selected from the group consisting of hammers, sledges, and mauls.

70. The method of claim 64, wherein said driving device applies a force to said head of said spike directed towards said tapered tip.

71. The method of claim 64, wherein said driving device is adapted to hold said spike in operational engagement with said driving device.

72. The method of claim 71, wherein said driving device is magnetic, and magnetic forces operate to hold said spike in the operational engagement with said driving device.

* * * * *